United States Patent [19]

FitzGerald-Smith

[11] 4,359,795

[45] Nov. 23, 1982

[54] BRIDGE PIERS

[75] Inventor: James P. FitzGerald-Smith, Ossemsley, England

[73] Assignee: The Secretary of State for Defence in Her Britannic Majesty's Government of the United Kingdom of Great Britain and Northern Ireland, London, England

[21] Appl. No.: 208,446

[22] Filed: Nov. 19, 1980

[30] Foreign Application Priority Data

Nov. 27, 1979 [GB] United Kingdom ..... 7940912

[51] Int. Cl.[3] ..... E01D 19/02

[52] U.S. Cl. ..... 14/75; 52/123.1; 405/197

[58] Field of Search ..... 14/75, 72, 73, 77; 405/196, 197; 52/123, 745, 637, 638

[56] References Cited

U.S. PATENT DOCUMENTS

| | | | |
|---|---|---|---|
| 85,171 | 12/1868 | Grant | 14/75 |
| 105,195 | 7/1870 | Gregory | 14/75 |
| 174,554 | 3/1876 | Mills | 14/75 |
| 848,304 | 3/1907 | Hines | 52/123 |
| 926,925 | 7/1909 | Carmony | 52/123 |
| 1,362,069 | 12/1920 | Witzel | 52/745 |
| 2,377,758 | 6/1945 | Cohen | 52/123 X |
| 2,857,026 | 10/1958 | Jones | 52/123 |
| 3,355,853 | 12/1967 | Wallace | 52/745 |

FOREIGN PATENT DOCUMENTS

| | | | |
|---|---|---|---|
| 2546893 | 4/1977 | Fed. Rep. of Germany | 14/75 |
| 293037 | of 1953 | Switzerland | 52/637 |

*Primary Examiner*—Nile C. Byers, Jr.

*Attorney, Agent, or Firm*—Pollock, Vande Sande & Priddy

[57] ABSTRACT

A bridge pier is constructed from a number of serially gradated cribs nestable one within the other for transportation and manually mountable one upon the other in order of decreasing size on arrival at a site by the use of rotatable davits attachable to each upper-most crib in turn. When used for dry gap bridging the cribs are assembled upon a pair of adjustable length telescopic legs each pivotally connected to a load-spreading grillage and adjustable for use on slopes of up to 1 in 20. Both initial levelling and subsequent adjustment for ground settlement can be achieved by adjustment of the telescopic legs. When required for use in deep water bridging the cribs may be mounted directly upon a pontoon.

7 Claims, 4 Drawing Figures

BRIDGE PIERS

This invention relates to bridge piers which are transportable and can be manually erected.

Transportable bridge piers suffer variously from a number of disadvantages such as a need for ancillary construction equipment, large stowed volume, heavy weight, lengthy construction time, small load bearing capacity and insufficient adaptability to ground settlement. One known example of a manually erectable bridge pier comprises a multiplicity of identical rectangular frameworks or cribs which can be manually assembled in any specific configuration. These cribs are easy to handle, weighing normally about 150 lbs each, but have a large stowed volume which is inconvenient for transportation purposes. The time taken for construction is fairly lengthy owing to the need to apply clamps at every interface and the completed assembly has no flexibility for settlement.

The present invention seeks to provide a bridge pier assembly having the handling advantages of the known crib assembly, but with less stowed volume per load bearing capacity and with shorter construction time.

In accordance with the present invention, a bridge pier assembly includes a multiplicity of serially gradated cribs, each nestable within the next larger in a stowed configuration and each mountable upon the next larger in an erected configuration, and a pair of davits attachable to two opposing end faces respectively of any one of the cribs so as to be rotatable in a substantially vertical plane when the crib is disposed in the erected configuration.

Preferably each davit comprises a jib and a counter jib adapted for mutual rotation in a derricking plane, ie vertical in use, each of which jibs bears adjacent its outermost end a pulley rotatable in the said derricking plane, a single line being reeved around both pulleys.

Where the bridge pier is to be used in bridging wet gaps, the cribs may be disposed in the erected configuration with the largest crib directly supported on a pontoon.

For use in bridging dry gaps however, the bridge pier assembly further includes two base units each comprising a grillage and a telescopic leg pivotally supportable upon the grillage, the two telescopic legs being jointly adapted for supporting the largest crib.

Preferably the grillage comprises a multiplicity of substantially parallel platens all independently pivoted to tiered support members, the final one of which supports a socket member engagable with a ball attached to the base of the telescopic leg.

Figure 1:
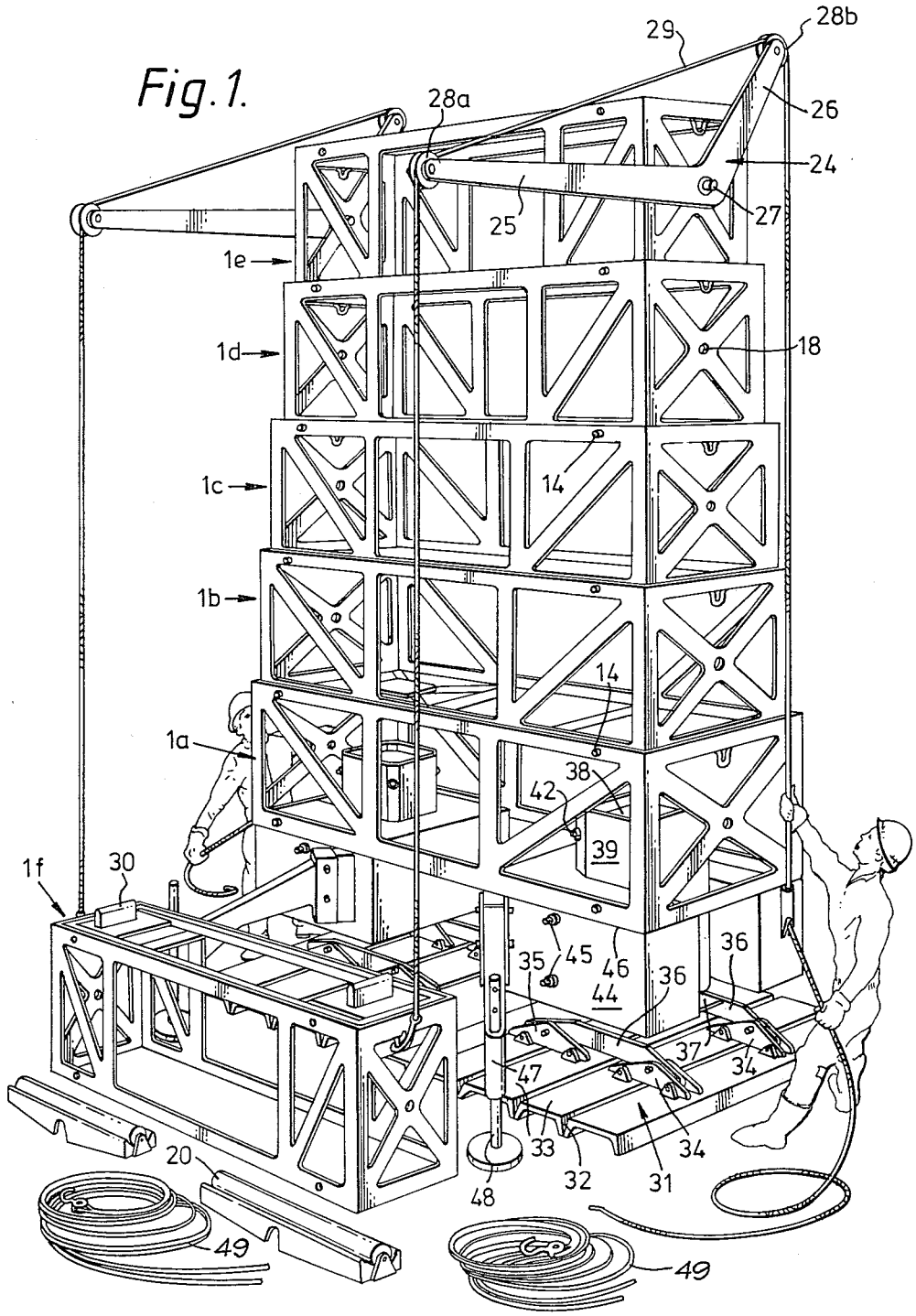
Figure 2:
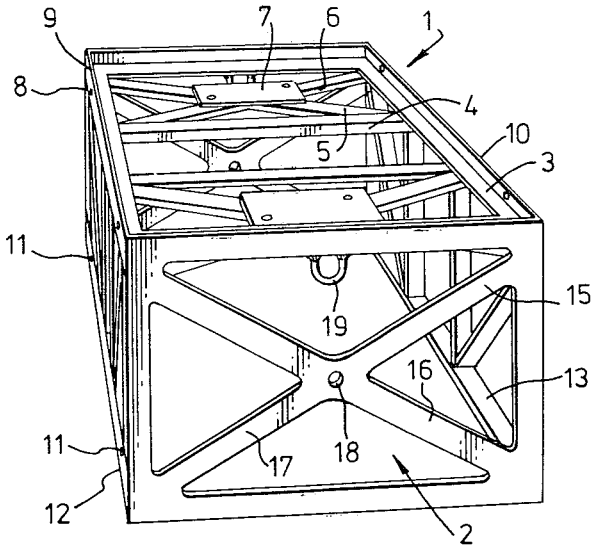
Figure 4:
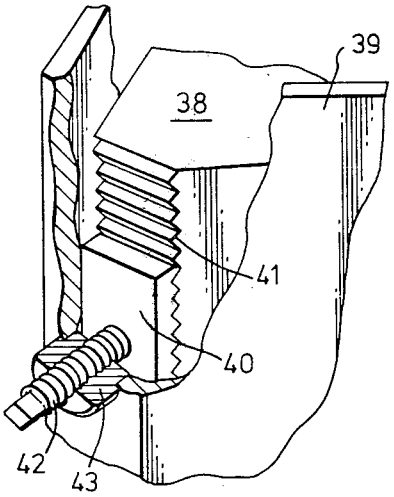
Figure 3:
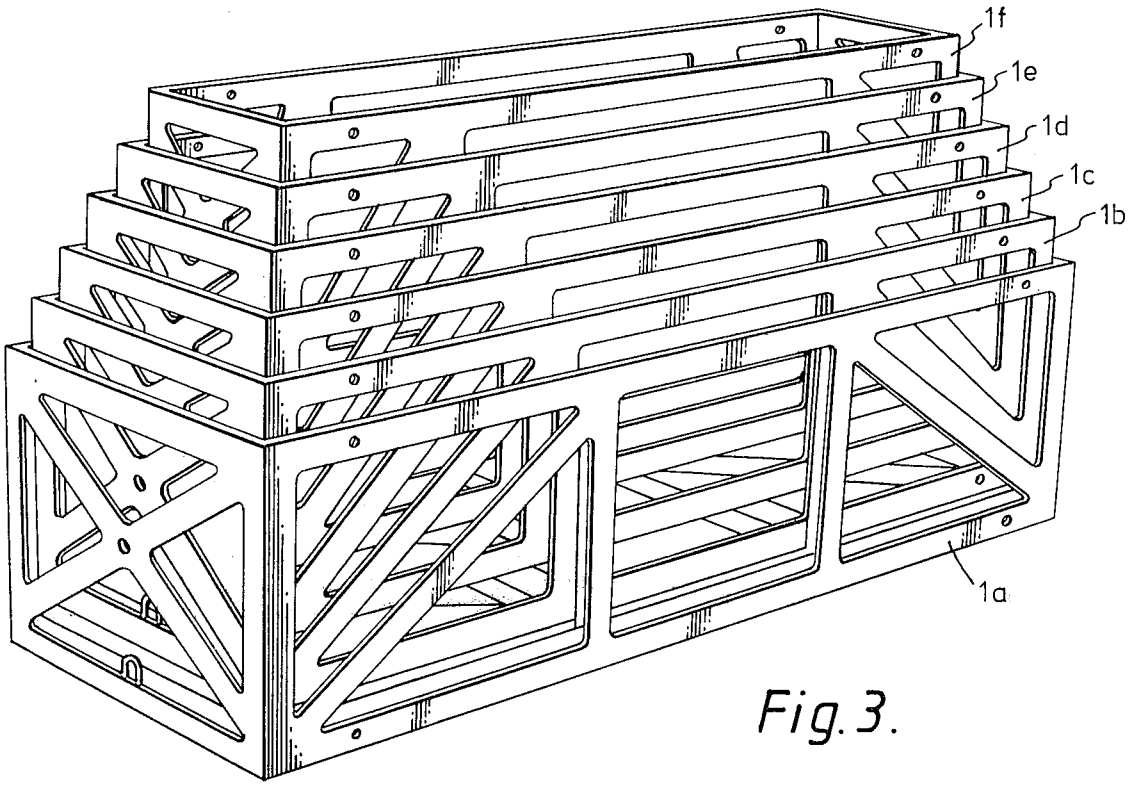

An embodiment of the invention will now be described by way of example only with reference to the attached drawings of which FIG. 1 is a general view of a semi-erected bridge pier, FIG. 2 is an oblique view of any one of the cribs illustrated in FIG. 1, FIG. 3 illustrates a stowed configuration for all of the cribs illustrated in FIG. 1 and FIG. 4 is a cut-away view of the leg clamp illustrated in FIG. 1.

The bridge pier assembly illustrated under construction in FIG. 1 comprises six cribs 1*a*, 1*b*, 1*c*, 1*d*, 1*e*, 1*f* of identical form but of serially reducing size each comprising a rectangular framework of steel girders as illustrated in FIG. 2. Each crib 1 has an open base 2 and a recessed top 3 within which the next smaller crib can be located, support being provided adjacent each end of the crib by cross braces 4, 5 and 6 and support plates 7. Holes 8 are provided in side top members 9 and 10 which holes align with corresponding holes 11 in the side base members 12 and 13 of the next smaller crib. Securing pins 14 (FIG. 1) are inserted in the aligned holes during erection.

Cross braces 15 and 16 are provided at each end face 17 of the crib 1 which are pierced at their intersection to provide a shaft bearing 18. A lifting eye 19 is also provided at each end face 17.

The open base 2 of the cribs 1 permits all six cribs to be nested when inverted, as illustrated in FIG. 3.

Two davits 24 are used during erection, each comprising a jib 25 and a counter jib 26 mounted radially upon a shaft 27, which shaft is slidably insertable in the shaft bearings 18 of each crib 1. Pulleys 28*a* and 28*b* are mounted at the outer extremity of the jib 25 and the counter jib 26 respectively, and a line 29 is reeved around both pulleys in turn.

Two rocker plates 30 for supporting transversely rockable bridge rollers 20 are mountable on the support plates 7 in the recessed top 3 of any one of the cribs 1 (1*f* as drawn). The bridge pier is constructed with a disposition selected to provide that these rollers will lie transversely to the line of an intended bridge span thereby to permit bridge span girders (not shown) to be longitudinally launched over the rollers.

Two base units 31 each include a grillage 32 consisting of four platens 33 pivotally connected in pairs to secondary support plates 34 and 35 which plates are themselves pivotally connected to a primary support plate 36. Two sets of the support plates 34, 35 and 36 are provided for the grillage 32, the two plates 36 being mutually connected to a platform 37.

The platform 37 supports a telescopic leg comprising an inner leg 38 and an adjustable outer leg 39, the inner leg 38 being pivotally connected to the platform 37 by means of a ball and socket joint (not shown). The outer leg 39 is vertically adjustable with respect to the inner leg 38 by means of a hand operated hydraulic jack (not shown) and is locked into position after adjustment by serrated clamps 40 (illustrated in FIG. 4) located one at each corner of the leg, each of which is brought into engagement with a rack 41 attached to the inner leg 38, by advancing screws 42 through threaded bushes 43 attached to the outer leg 39, the screws 42 being rotatably captive within the clamps 40. Secured to the outer leg 39 by pins 45 is a U-shaped mounting block 44 having a shoulder 46 at its upper edge for locating and supporting the base 2 of the crib 1*a*.

Two outriggers 47 having adjustable legs 48 are attachable to each block 44 at the front and back faces (as drawn) to support the pier during construction.

Erection of the bridge pier is as follows. After suitably positioning the base units 31 with the grillage platens 33 orientated to lie in a direction normal to the slope of the ground upon which they are sited, the crib 1*a* is lifted onto the two mounting blocks 44 so that its base 2 engages with the shoulders 46 and is pinned in position by securing pins 14 inserted in the holes 11 and corresponding holes in the blocks. Preliminary levelling of the crib 1*a* is carried out by means of the hydraulic jacks and the outrigger legs 48 are adjusted accordingly.

The shafts 27 of the davits 24 are then mounted in the shaft bearings 18 at each end face of the crib 1*a* and the two lines 29 extending from the two pulleys 28*a* are respectively attached to the two lifting eyes 19 of the crib 1*b*. The crib 1*b* is then hauled up as far as the pulleys 28*a* by means of the lines 29 extending from the pulleys 28*b*, whereupon further tension on the lines causes the shafts 27 to rotate in the shaft bearings 18 thereby rotating the jib 25 upwards and swinging the crib 1*b* onto the top of the crib 1*a* to locate in its recessed top 7. Over-swing is prevented by arrest of the counter jib 26 against the crib 1*a*.

The crib 1*b* is secured to the crib 1*a* with further securing pins 14 and the davits 24 moved up from the crib 1*a* to the crib 1*b*. This process is repeated until all six cribs, or as many as are required, are in position and the rollers 20 have been mounted. The davits 24 are then removed, and guy lines 49 are secured at one end to the top crib, and at the other end to ground anchorages (not shown). The pier is finally levelled by means of the hydraulic jacks, the outer legs 39 are locked into position by engaging the clamps 40 with the racks 41, and the adjustable legs 48 of the outriggers 47 are raised from the ground. The pier is then ready for a bridge span to be laid on the rollers 20.

Adjustment for any settlement that may occur during use can be made without removing the bridge span, simply by releasing the leg clamps 40, re-levelling the pier by means of the jacks and re-engaging the clamps. The provision of these leg clamps permits the use of hydraulic jacks for adjustment purposes which need only have sufficient power to lift the dead weight of the bridge, all further operational loads being borne by the leg clamps. This reduces the necessary jack diameter with consequent improvement in adjustment rate.

A specific example of this embodiment, having a largest crib weighing approximately 250 lbs and measuring 14 feet by 5 feet, can be erected by 8 men in 15 minutes and is capable of carrying a load of 60 tons on each base unit 31. Each grillage 32 weighs about 300 lbs and can be lifted by 4 men. The davits 24 weigh about 25 lbs each and can be deployed by one man climbing on the cribs. The ball and socket joint connecting the inner leg 38 to the platform 37 can accomodate ground slopes of one in twenty, while the pivotted support plates 34, 35 and 36 ensure that the load is evenly distributed to all four grillage platens 33. In its stowed configuration the whole pier can be packed onto a single pallet to occupy a volume no greater than 14 ft by 8 ft by 6 ft with a total weight of approximately 4,000 lbs, which is well within the lifting capability of a medium-lift helicopter.

This embodiment can be erected on dry land and in shallow water of up to two feet in depth. Piers required to be situated in deeper waters may be erected upon pontoons, in which case the base units 31 are omitted, the lowest crib 1*a* being supported directly upon the pontoon.

I claim:

1. A bridge pier assembly including a multiplicity of serially gradated cribs, each nestable within the next larger in a stowed configuration and each mountable upon the next larger in an erected configuration, a pair of davits attachable to two opposing end faces respectively of any one of the cribs so as to be rotatable in a substantially vertical plane when the crib is disposed in the erected configuration, and a pair of base units each comprising a grillage and a telescopic leg pivotally supportable upon the grillage, the telescopic legs in said base units being adapted for jointly supporting the largest crib.

2. A bridge pier assembly as claimed in claim 1 wherein each davit comprises a jib and a counter jib adapted for mutual rotation in a derricking plane, each of which jibs bears adjacent its outermost end a pulley rotatable in the said derricking plane.

3. A bridge pier assembly as claimed in claim 1 wherein said grillage comprises a multiplicity of substantially parallel platens all independently pivoted to pivotally-tiered support members, the uppermost one of which in use is pivotally connected to the base of said telescopic leg.

4. A bridge pier assembly as claimed in claim 1 wherein each telescopic leg comprises an inner leg and a relatively axially slideable outer leg having co-engageable, transversely serrated clamping means.

5. A bridge pier assembly as claimed in claim 1 further including a pair of adjustable outrigger legs attached to each of said base units.

6. A bridge pier assembly as claimed in claim 1 further including a pair of rockable bridge rollers mountable upon any one of the erected cribs for use in positioning bridge span girders in place after the bridge pier assembly has been erected.

7. A method of erecting a bridge pier using the bridge pier assembly claimed in claims 5 and 6 including the steps of a. positioning the base units at a chosen site with the grillage platens orientated so as to lie transversely to the slope of the site,
b. securing the largest crib to the two base units,
c. levelling the largest crib by preliminary adjustment of the telescopic legs,
d. adjusting the outrigger legs so as to provide lateral stability to the assembled crib and base units,
e. sequentially lifting the cribs by means of the davits to rest one upon the other in order of decreasing size,
f. securing the bridge rollers to the top-most crib,
g. securing the top-most crib by guylines,
h. levelling the complete assembly by final adjustment of the telescopic legs,
i. locking the telescopic legs,
j. tightening the guylines, and
k. raising the outrigger legs from the ground.

* * * * *